US010328701B2

(12) United States Patent
Van Rens

(10) Patent No.: US 10,328,701 B2
(45) Date of Patent: Jun. 25, 2019

(54) METHOD OF CALIBRATING A WIPER POSITION IN AN INK JET PRINTER

(71) Applicant: Océ Holding B.V., Venlo (NL)

(72) Inventor: Benjamin P. H. Van Rens, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/908,222

(22) Filed: Feb. 28, 2018

(65) Prior Publication Data

US 2018/0250936 A1 Sep. 6, 2018

(30) Foreign Application Priority Data

Mar. 6, 2017 (EP) ..... 17159433

(51) Int. Cl.

| | |
|---|---|
| ***B41J 2/16*** | (2006.01) |
| ***B41J 2/165*** | (2006.01) |
| ***B41J 2/045*** | (2006.01) |
| *B41J 2/14* | (2006.01) |

(52) U.S. Cl.

CPC ..... *B41J 2/162* (2013.01); *B41J 2/0451* (2013.01); *B41J 2/04581* (2013.01); *B41J 2/16535* (2013.01); *B41J 2/16538* (2013.01); *B41J 2/16544* (2013.01); *B41J 2/16547* (2013.01); *B41J 2/04541* (2013.01); *B41J 2002/14354* (2013.01); *B41J 2002/1655* (2013.01); *B41J 2002/16591* (2013.01)

(58) Field of Classification Search

CPC ..... B41J 2/16538; B41J 2/16547; B41J 2/16544; B41J 2/16535; B41J 2/04581; B41J 2/04541; B41J 2002/16591; B41J 2002/1655; B41J 2002/14354

See application file for complete search history.

(56) References Cited

U.S. PATENT DOCUMENTS

| | | | | |
|---|---|---|---|---|
| 8,882,239 | B2 | 11/2014 | Miedema et al. | |
| 2013/0155141 | A1* | 6/2013 | Miedema | B41J 2/16538 347/19 |

FOREIGN PATENT DOCUMENTS

| | | |
|---|---|---|
| EP | 1 378 359 A1 | 1/2004 |
| EP | 1 378 360 A1 | 1/2004 |

OTHER PUBLICATIONS

European Search Report for EP 17 15 9433, dated Aug. 8, 2017.

* cited by examiner

*Primary Examiner* — Sharon A. Polk

(74) *Attorney, Agent, or Firm* — Birch, Stewart, Kolasch & Birch, LLP

(57) ABSTRACT

A method of calibrating a wiper position in an ink jet printer having a nozzle plate and a wiper arranged to wipe the nozzle plate, the nozzle plate having a number of nozzles each of which is in fluid communication with a pressure chamber, each pressure chamber having an actuator for exciting a pressure wave in a liquid in the pressure chamber, and a detection system arranged to detect pressure fluctuations in the pressure chamber includes adjusting the wiper to a position in which it is set against the nozzle plate; exciting a pressure wave in at least one of the pressure chambers; recording the pressure fluctuations in said at least one pressure chamber; deciding, on the basis of the detected pressure fluctuations, whether the wiper is set correctly against the nozzle that is in fluid communication with said at least one pressure chamber; and correcting the position of the wiper if necessary.

7 Claims, 4 Drawing Sheets

METHOD OF CALIBRATING A WIPER POSITION IN AN INK JET PRINTER

The invention relates to a method of calibrating a wiper position in an ink jet printer having a nozzle plate and a wiper arranged to wipe the nozzle plate, the nozzle plate having a number of nozzles each of which is in fluid communication with a pressure chamber, each pressure chamber having an actuator for exciting a pressure wave in a liquid in the pressure chamber, and a detection system arranged to detect pressure fluctuations in the pressure chamber.

An ink jet printer in the meaning of the present disclosure is any device that is capable of ejecting droplets of a liquid onto a substrate at precisely controlled positions, so as to form an image on the substrate, for example, or for forming a three-dimensional object by applying a curable liquid on the substrate. In the latter case, the liquid does not have to be an "ink" in the proper sense of the word but may for example also be molten metal or the like.

In operation, the pressure chambers are filled with ink, and the surface tension of the ink or a slight underpressure in the pressure chamber prevents the ink from a leaking out through the nozzle. In order to eject an ink droplet, a pulse signal is applied to the actuator, e.g. a piezoelectric actuator, so that the actuator generates an acoustic pressure wave that propagates in the pressure chamber and, when it reaches the nozzle, causes a droplet to be expelled from the nozzle.

The detection system may be used to monitor residual pressure fluctuations which decay in the pressure chamber after a droplet has been ejected. This permits for example to check whether the ink droplets are ejected correctly or whether the nozzle orifice is obstructed by contaminants or the like.

EP 1 378 359 A1 and EP 1 378 360 A1 describe ink jet printers in which a piezoelectric transducer which is used as the actuator for generating the pressure waves is used also as a sensing element of the detection system for detecting the residual pressure fluctuations. U.S. Pat. No. 8,882,239 B2 describes an ink jet printer wherein the detection system is used for detecting the presence of a wiper on the nozzle plate in the context of monitoring the proper function of a maintenance system for the print head.

Ink jet printers are frequently equipped with maintenance systems in which a wiper is used for cleaning the surface of the nozzle plate from time to time in order to remove residual ink or other contaminants that may have accumulated on the nozzle plate and may compromise the process of droplet ejection.

Typically, a known ink jet printer comprises a plurality of print heads which are carefully adjusted so that their nozzle plates are arranged in a common plane. Then, the wiper should be carefully adjusted such that an active edge of the wiper is parallel with the plane of the nozzle plates so that the entire surface area of all nozzle plates may be wiped evenly. The wiper may be stationary, and the wiping operation may be induced by moving a print head carriage relative to the wiper. In other embodiments the wiper may be mounted on a separate carriage that is movable relative to the print heads. In that case a guide rail for the wiper carriage has to be adjusted such that it extends in parallel with the plane of the nozzle plates in order to prevent the wiper form moving away from the nozzle plates while travelling along the guide rail. Further, a slight torsional deformation of the guide rail may destroy the parallel alignment of the active edge of the wiper with the nozzle plates. It is therefore known to provide mechanical adjustment mechanisms for finely adjusting the position of a wiper on a wiper mount and/or adjusting the position of a guide rail for the wiper carriage. These adjusting mechanisms permit to calibrate the position of the wiper before the printer is delivered to the customer and/or after the wiper or an entire maintenance unit of the printer has been exchanged.

It is an object of the invention to provide a simple and reliable method of calibrating the wiper position.

In order to achieve this object, the method according to the invention comprises the steps of:

a) adjusting the wiper to a position in which it is set against the nozzle plate;
b) exciting a pressure wave in at least one of the pressure chambers;
c) recording the pressure fluctuations in said at least one pressure chamber;
d) deciding, on the basis of the detected pressure fluctuations, whether the wiper is set correctly against the nozzle that is in fluid communication with said at least one pressure chamber; and
e) correcting the position of the wiper if necessary.

According to this method, the signal from the detection system is used for verifying the position of the wiper with an accuracy and reliability that could hardly be achieved by a visual inspection or other measurements and does not require any additional measuring equipment.

More specific optional features of the invention are indicated in the dependent claims.

The operation of adjusting the wiper may comprise a step of mechanically adjusting a wiper mount in one or more degrees of freedom. In a case where the wiper is mounted on a wiper carriage, the process of adjusting the wiper may also comprise a step of adjusting a guide rail for the wiper carriage in one or more degrees of freedom.

In a printer with a plurality of print heads, a single wiper may be provided for wiping the nozzle plates of several print heads and the method according to the invention may be used for checking whether the wiper is correctly aligned with the common plane of the nozzle plates so that all nozzle plates are uniformly engaged by the wiper. By identifying, in each print head, the individual nozzles that are affected by the presence of the wiper, it is also possible to confirm whether the active edge of the wiper is inclined relative to the nozzle rows of the print head. These tests can also be made in case of a printer where separate wipers are provided for the different print heads but the wipers are mounted on a common base or carriage.

The step of exciting a pressure wave in at least one of the pressure chambers does not necessarily require that the intensity of the pressure wave is large enough to actually eject a droplet. In the calibration process, the intensity of the pressure wave may be reduced such that no droplets are ejected but the presence of the wiper still influences the pattern of the pressure fluctuations.

It is also possible to move the wiper or wipers over the nozzle plate or nozzle plates while the pressure waves are excited permanently or periodically with high frequency in a plurality of the pressure chambers or in all of the pressure chambers.

The liquid in which the pressure waves are excited does not necessarily have to be the liquid (ink) that is used in operation of the printer but may also be a cleaning liquid, for example.

Since the method permits to detect the correct positioning of the wiper or wipers without human intervention, it is also possible to partly or fully automate the calibration process by controlling electro-motoric drivers for the various adjusting mechanisms.

Embodiment examples will now be described in conjunction with the drawings, wherein.

Figure 1:
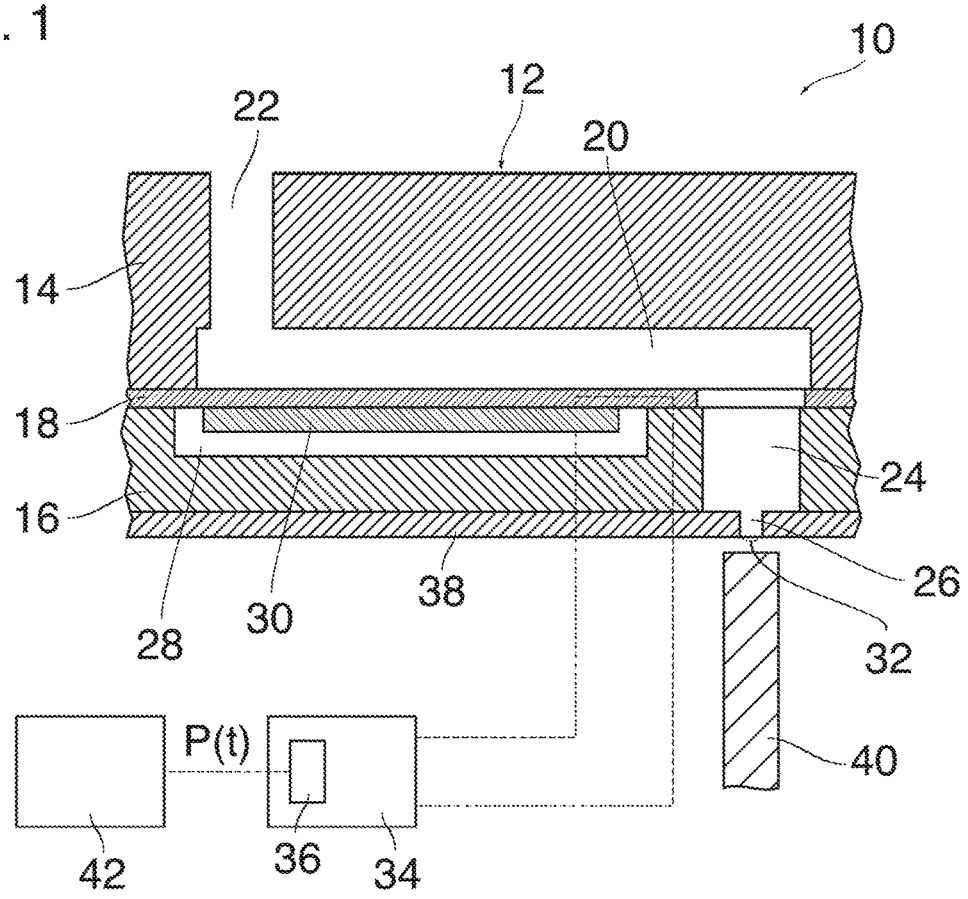
FIG. 1 is a sectional view of an individual printing element of an ink jet printer to which the invention is applicable.

A single ejection unit of an ink jet print head 10 has been shown in FIG. 1. A body 12 of the print head comprises a wafer 14 and a support member 16 that are bonded to opposite sides of a thin flexible membrane 18.

A recess that forms a pressure chamber 20 is formed in the face of the wafer 14 that engages the membrane 18, e.g. the bottom face in FIG. 1. The pressure chamber 20 has an essentially rectangular shape. An end portion on the left side in FIG. 1 is connected to an ink supply line 22 that passes through the wafer 14 in thickness direction of the wafer and serves for supplying liquid ink to the pressure chamber 20.

An opposite end of the pressure chamber 20, on the right side in FIG. 1, is connected, through an opening in the membrane 18, to a chamber 24 that is formed in the support member 16 and opens out into a nozzle 26 that is formed in the bottom face of the support member.

Adjacent to the membrane 18 and separated from the pressure chamber 20, the support member 16 forms another cavity 28 accommodating a piezoelectric actuator 30 that is bonded to the membrane 18.

An ink supply system which has not been shown here keeps the pressure of the liquid ink in the pressure chamber slightly below the atmospheric pressure, e.g. at a relative pressure of −1000 Pa, so as to prevent the ink from leaking out through the nozzle 26. In the nozzle orifice, the liquid ink forms a meniscus 32.

The piezoelectric actuator 30 has electrodes that are connected to an electronic circuit 34 which controls a voltage to be applied to the actuator. The circuit 34 further includes a detection system 36 for detecting pressure fluctuations in the pressure chamber 20, using the piezoelectric actuator as a pressure sensing element.

When an ink droplet is to be expelled from the nozzle 26, the circuit 34 outputs a voltage pulse to the actuator 30. This voltage pulse causes the actuator to deform in a bending mode. More specifically, the actuator 30 is caused to flex downward, so that the membrane 18 which is bonded to the actuator 30 will also flex downward, thereby to increase the volume of the pressure chamber 20. As a consequence, additional ink will be sucked-in via the supply line 22. Then, when the voltage pulse falls off again, the membrane 18 will flex back into the original state, so that a positive acoustic pressure wave is generated in the liquid ink in the duct 20. This pressure wave propagates to the nozzle 26 and causes an ink droplet to be expelled.

The acoustic wave that has caused a droplet to be expelled from the nozzle 26 will be reflected (with phase reversal) at the open nozzle and will propagate back into the pressure chamber 20. Consequently, even after the droplet has been expelled, a gradually decaying acoustic pressure wave is still present in the pressure chamber 20, and the corresponding pressure fluctuations exert a bending strain onto the membrane 18 and the actuator 30. This mechanical strain on the piezoelectric transducer leads to a change in the impedance of the transducer, and this change can be measured with the detection system 36. The measured impedance changes represent the pressure fluctuations of the acoustic wave and can therefore be used to derive a time-dependent function P(t) that describes these pressure fluctuations.

As is shown in FIG. 1, the nozzle 26 is formed in a nozzle plate 38 that constitutes the bottom face of the print head 10. In other embodiments the nozzle plate may be an integral part of the body 12. When the print head has been in use for certain time, the bottom surface of the nozzle plate 38 may become stained with residual ink and with other contaminants. This may change the direction, size and speed of the ink droplets that are ejected from the nozzle 26 and may therefore compromise the print quality. For this reason, the print head 10 is subjected to maintenance operations from time to time in order to clean the nozzle plate 38. To that end, the print head 10 is moved to a maintenance station where a wiper 40 is suitably positioned for wiping the bottom face of the nozzle plate 38 in order to clean the same.

When an active edge (top edge in FIG. 1) of the wiper 40 engages the nozzle plate 38 at the position of the nozzle 26 so that the nozzle is partly or fully obstructed, this will change the acoustic reflection properties of the nozzle orifice and will consequently change the pattern of pressure fluctuations in the pressure chamber 20 in a characteristic way. This effect may be utilized for detecting the presence of the wiper 40 at the nozzle 26.

In the example shown in FIG. 1, a processor 42 is connected to the detection system 36 of the circuit 34 for analyzing the function P(t) that represents the pressure fluctuations, and for comparing this function to reference patterns that have been stored in a memory of the processor. The reference patterns may for example be samples of the function P(t) that have been recorded beforehand for different positions of the wiper 40 relative to the nozzle 26, including, for example, a position where the nozzle 26 is fully obstructed by the wiper 40 and a position where the wiper is far away from the nozzle 26 so that it has no influence on the pressure fluctuations. Other patterns may describe situations where the nozzle is partly blocked by the wiper, and there may also be reference patterns that have been recorded in situations in which the wiper 40 was pressed against the nozzle 26 with different forces, so that it may even be possible to estimate the force with which the wiper 40, which is made of an elastic material, is compressed at the nozzle plate 38.

The capability of the processor 42 to detect the presence of the wiper 40 is utilized for calibrating the position of the wiper 40 as will now be described by reference to FIGS. 2 to 7.

Figure 2:
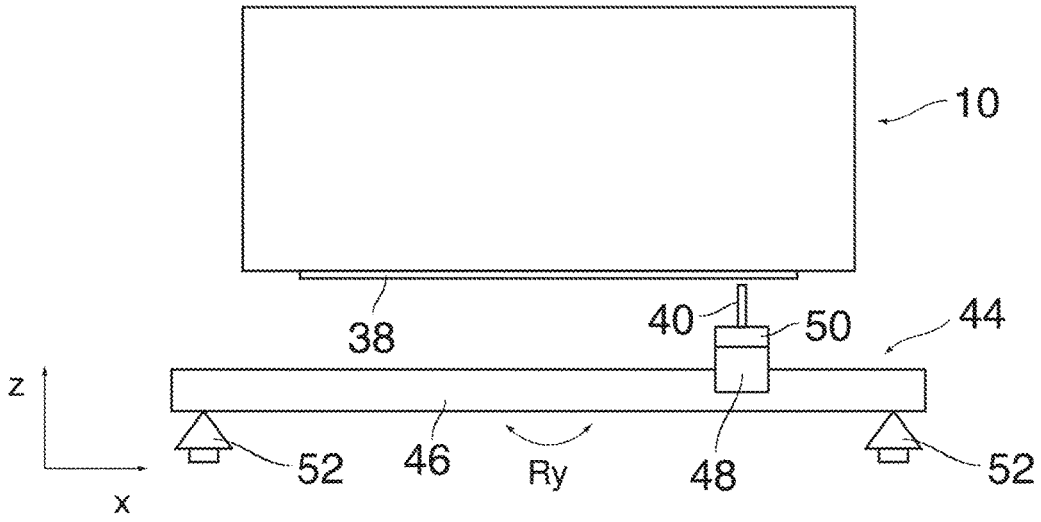
FIG. 2 is a side view of a print head and a maintenance system.

FIG. 2 is a side view of the print head 10 which, internally, is provided with a large number of printing elements of the type shown in FIG. 1, with the nozzles 26 of the various printing elements being arranged in a row in a direction x. The print head 10 is shown in a maintenance station, so that the nozzle plate 38 faces a maintenance system 44 that comprises a guide rail 46 extending in the direction x, a wiper carriage 48 movable along the guide rail 46, and a wiper mount 50 mounted on the wiper carriage 48 and carrying the wiper 40 and holding the wiper 40 in a position in which it can wipe the nozzle plate 38 when the wiper carriage 48 moves along the guide rail 46.

Adjusting devices 52 are provided at both ends of the guide rail 46 for independently adjusting the positions of the respective ends of the guide rail 46 in a height direction z normal to the plane of the nozzle plate 38. Thus, the adjusting devices 52 permit to adjust the height of the guide rail 46 as a whole in the direction z, as well as the angle of inclination of the guide rail 46 about an axis Ry which extends normal to the plane of the drawing in FIG. 2. Optionally, the adjusting devices 52 may also permit an adjustment of the respective end of the guide rail 46 in a direction y (normal to the plane of the drawing in FIG. 2) and, therewith, to adjust the angle of inclination of the guide rail 46 about an axis Rz (FIG. 6) that extends in the z-direction. In this way, it is possible to adjust the guide rail 46 to be perfectly parallel to the row of nozzles 26 in the nozzle plate 38.

Optionally, the wiper mount 50 may have its own adjusting devices for adjusting the position of the wiper 40 relative to the carriage 48 in one or more degrees of freedom. In particular, it may be useful to be able to adjust the height of the wiper 40 in the z-direction, the lateral position of the wiper 40 in the y-direction as well as the inclination of the active edge of the wiper 40 about an axis Rx (FIG. 5) in the x-direction, although there may be some redundancy between these adjustment options and the adjustment options for the guide rail 46.

In a practical embodiment, the print head 10 shown in FIG. 1 is only one of a plurality of print heads that are disposed side by side in the direction y and arranged such that their nozzle plates 38 lie in a common plane parallel to the x-y-plane. By way of example FIG. 3 shows a print head assembly with eight print heads 10 which may be provided for printing with different inks, e.g. in different colors and may be mounted on a common print head carriage (not shown).

Figure 3:
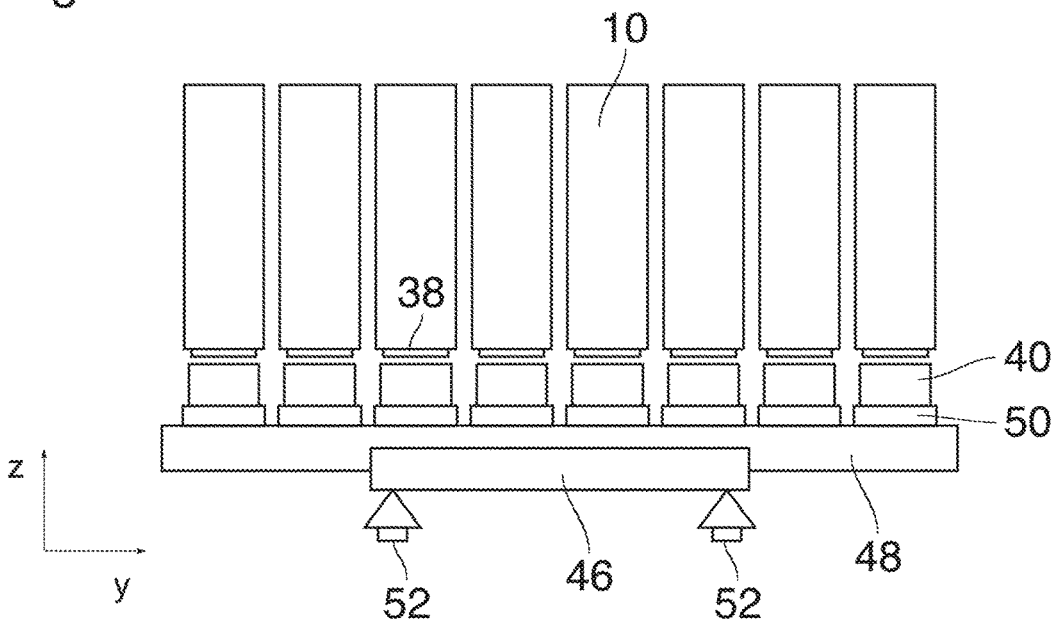
FIG. 3 is a front view of the maintenance system and a plurality of print heads.

In the example shown in FIG. 3, each of the print heads 10 has its own wiper 40 and its own wiper mount 50, but all eight wiper mounts 50 are mounted on the common wiper carriage 48 which therefore has a considerable extension in the direction y. In order to hold the wiper carriage 48 in a stable position, the guide rail 46 is also extended in the direction y and each end of the guide rail 46 is supported on a pair of adjusting devices 52 which permit an independent adjustment in the z-direction, so that it is also possible to adjust the angle of inclination of the wiper carriage 48 about the axis Rx extending in the x-direction.

Figure 4:
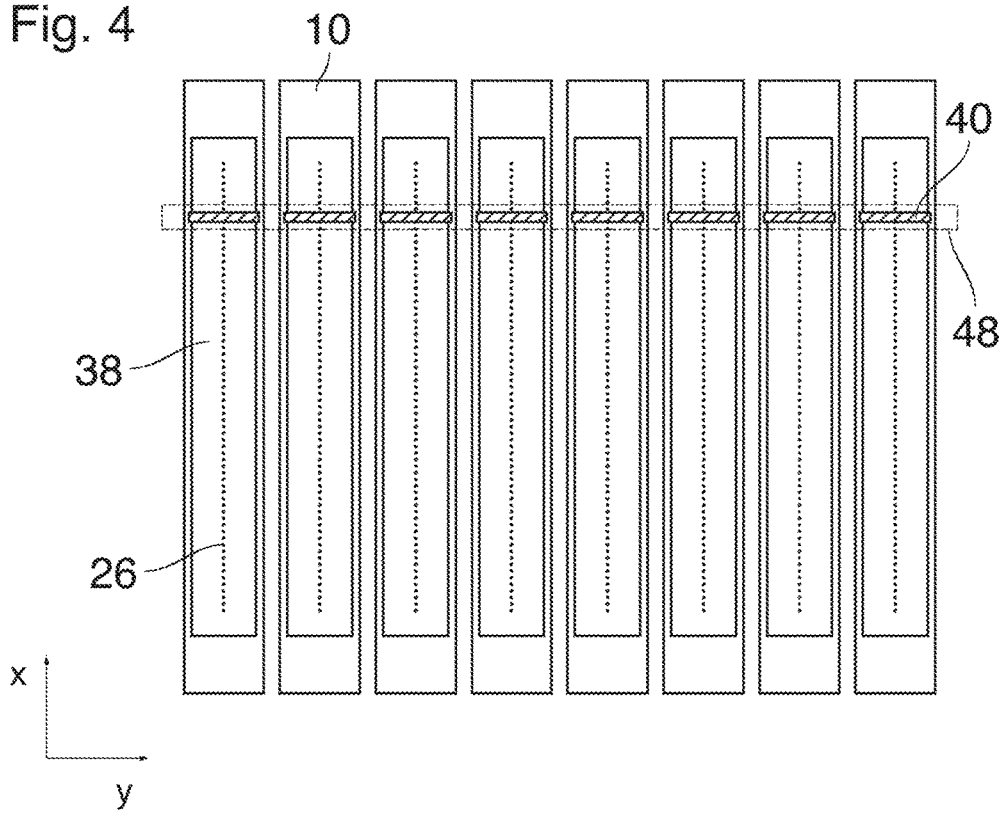
FIG. 4 is a bottom view of the print heads and parts of the maintenance system.

FIG. 4 is a bottom view of the print head assembly showing the print heads 10 and their nozzle plates 38 as well as a row of nozzles 26 in each nozzle plate. The wipers 40 have been shown in cross-section, and the position of the wiper carriage 48 has been indicated in phantom lines.

Several adjustment options will now be described with reference to FIGS. 5 and 6.

Figure 5:
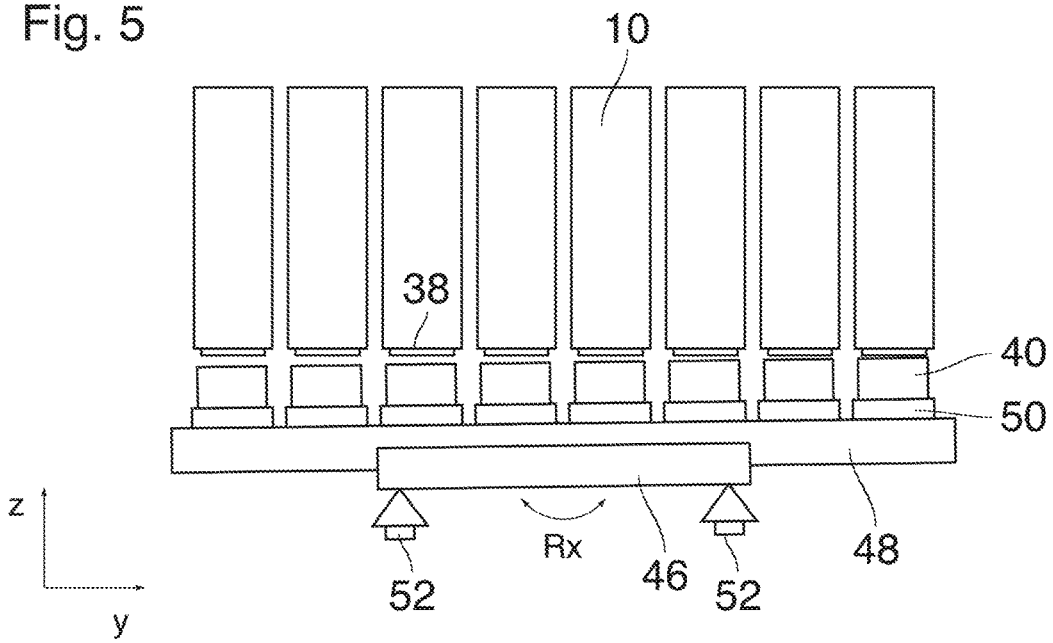
FIGS. 5 and 6 are views analogous to FIGS. 3 and 4, respectively, and show examples of adjustment errors.

FIG. 5 illustrates a situation where the guide rail 46 has been rotated about the axis Rx. As a result, the active edges of the wipers 40 are no longer parallel to the plane of the nozzle plates 38. Using the system shown in FIG. 1, this misalignment may be detected by energizing the printing elements in the leftmost and rightmost print heads 10 and checking whether the presence of the wiper 40 can be detected for at least one print element in these print heads. The result will be that the presence of the wiper 40 is detected for the rightmost print head in FIG. 5 but not for the leftmost print head. Then, in order to re-calibrate the positions of the wipers 40, the adjusting devices 52 may be used for rotating the guide rail 46, clock-wise in FIG. 5, until the presence of the wiper 40 is also detected for the leftmost print head.

When the test for the angular position of the guide rail 46 about the axis Rx is repeated for different x-positions of the wiper carriage 48 along the guide rail 46, different results may be obtained for different positions because the guide rail 46 may be twisted about its longitudinal axis. This error may be compensated for by rotating the opposite ends of the guide rail 46 in the x-direction independently of one another, until the twist has been removed and, consequently, the wiper 40 of the leftmost and the rightmost print heads 10 can be detected in all x-positions of the carriage.

Similarly, the measurements may show that the guide rail 46 has been rotated the axis Ry, resulting in an inclination of the guide rail 46 relative to the horizontal plane in the view shown in FIG. 2. In that case, the measurements with the leftmost and rightmost print heads in FIG. 5 (or measurements with all eight print heads) will detect the presence of the wipers 40 when the print head carriage 48 is at one end of the guide rail 46, but will fail to detect the presence of the wipers when the print head carriage 48 has been moved to the opposite end of the guide rail. This error can be corrected by using the adjusting devices 52 at the opposite ends of the guide rail 46 for rotating the guide rail about the axis Ry (FIG. 2), but without rotation about the axis Rx (FIG. 5). Repeated tests with the system detecting the presence of the wipers 40 will show whether the correction has been successful.

In order for the adjustment operations described above to be performed properly, it is required that the active edges of all wipers 40 are aligned with each other. This condition may also be tested with the system shown in FIG. 1. To that end, the guide rail 46 is lowered in z-direction and is then gradually lifted again while all print heads 10 are active and attempt to detect the presence of their respective wipers. If the wipers are not properly aligned, one of the wipers will be detected earlier than the others. Then, the wiper mount 50 of that wiper may be used for lowering the wiper relative to the wiper carriage 48 while the guide rail 46 is lifted (without rotation) until at least two wipers 40 are detected simultaneously. Then, these processes may be repeated until all eight wipers 40 are detected simultaneously.

Figure 6:
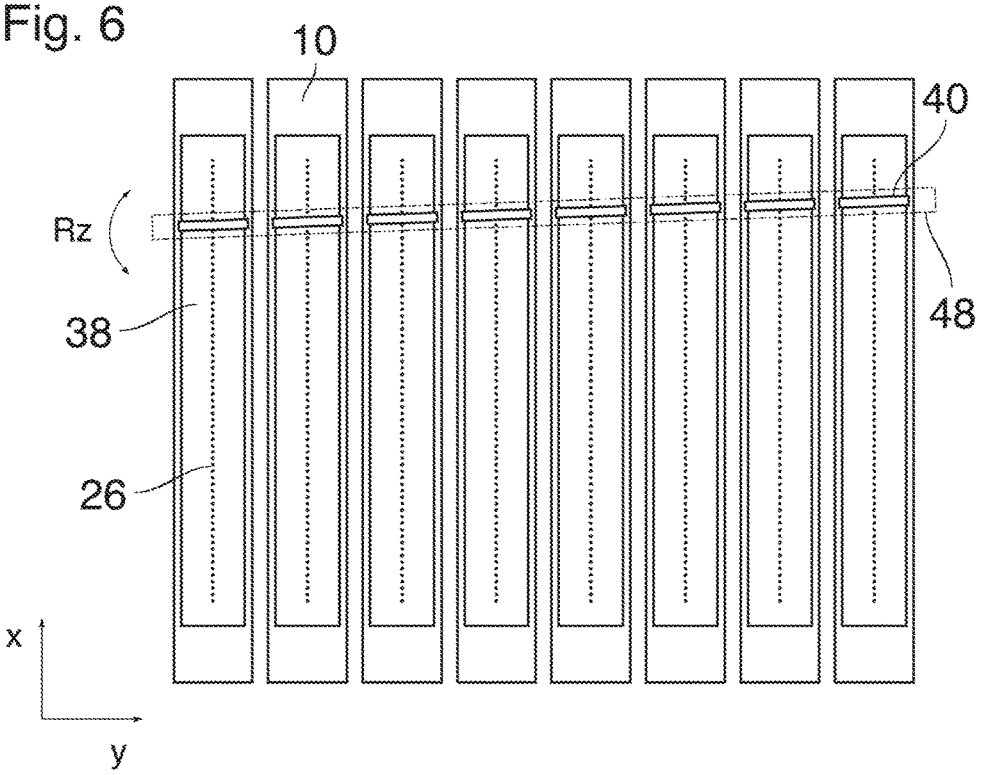

FIG. 6 illustrates a situation where the wiper carriage 48 is skewed, so that it is no longer orthogonal to the rows of nozzles 26. Such a situation may be undesired because it spoils the symmetry of the wiping action relative to the rows of nozzles 26 and may also cause unwanted shear stresses in the wipers 40. Further, since the wipers 40 are made of an elastic material and extend beyond the edges of the nozzle plate 38, the central portion of the wiper will be depressed by the nozzle plate when the wiper is pressed against the nozzle plate, whereas the opposite ends of the wiper will straddle the edges of the nozzle plate. It is therefore desired that the longitudinal direction of the guide rail 46 is precisely in parallel with the direction of the longitudinal edges of the nozzle plates 38 in order to permit a smooth movement of the wipers over the nozzle plates with a minimum of wear and frictional resistance. This requirement is equivalent to the requirement that the wiper carriage 48 extends exactly at right angles to the rows of nozzles 26, other than in FIG. 6.

An error of this type may be detected by identifying, in each of the print heads 10, the printing elements for which the presence of the wipers 40 is detected. In the example shown, if the nozzles 26 in each row are numbered from top to bottom in FIG. 6, the nozzle which detects the wiper in the leftmost print head will have a higher number than the nozzle which detects the wiper in the rightmost print head. In order to correct for the error, the adjusting devices 52 at the opposite ends of the guide rail 46 may be used for adjusting the y-positions of these ends independently so as to rotate the guide rail 46 and the wiper carriage 48 about the axis Rz shown in FIG. 6.

Considering that the print heads 10 are mounted on a carriage, another possibility to detect errors of this type would be to move the print head carriage relative to the wipers 40 while the print heads are active to detect the presence of the wipers. Then, while the print head carriage is moving, it is possible to detect the carriage position where the print heads first detect the presence of the wipers. When this measurement is repeated for different x-positions of the wiper carriage 48, the detected carriage positions will differ from one another when the guide rail 46 is not parallel to the rows of nozzles 26 and hence to the lateral edges of the nozzle plates 38. Then, the alignment error can again be corrected by rotating the guide rail 46 about the axis Rz (FIG. 6).

Depending upon the shape and configuration of the wipers 40, the areas of contact between the wipers 40 and the nozzle plates 38 may be such that, when the wiper is properly set against the nozzle plates 38 in the z-direction, at least one of the nozzles 26 will be obstructed in any of the x-positions of the wiper. In another configurations, there may however be cases where a wiper, although it is properly set against the nozzle plate, does not obstruct any of the nozzles. Such a situation may occur for example when friction between the wiper and the nozzle plate causes the wiper to be deflected while the wiper carriage 48 moves in the x-direction, so that a leading edge of the wiper makes only a line-contact with the nozzle plate. Still, it is possible to detect the presence of the wiper by activating a plurality of neighbouring printing elements while moving the wiper over the range that is defined by these printing elements. Then, the nozzles 26 of the printing elements will be blocked one after the other as the wiper moves in the x-direction.

Figure 7:
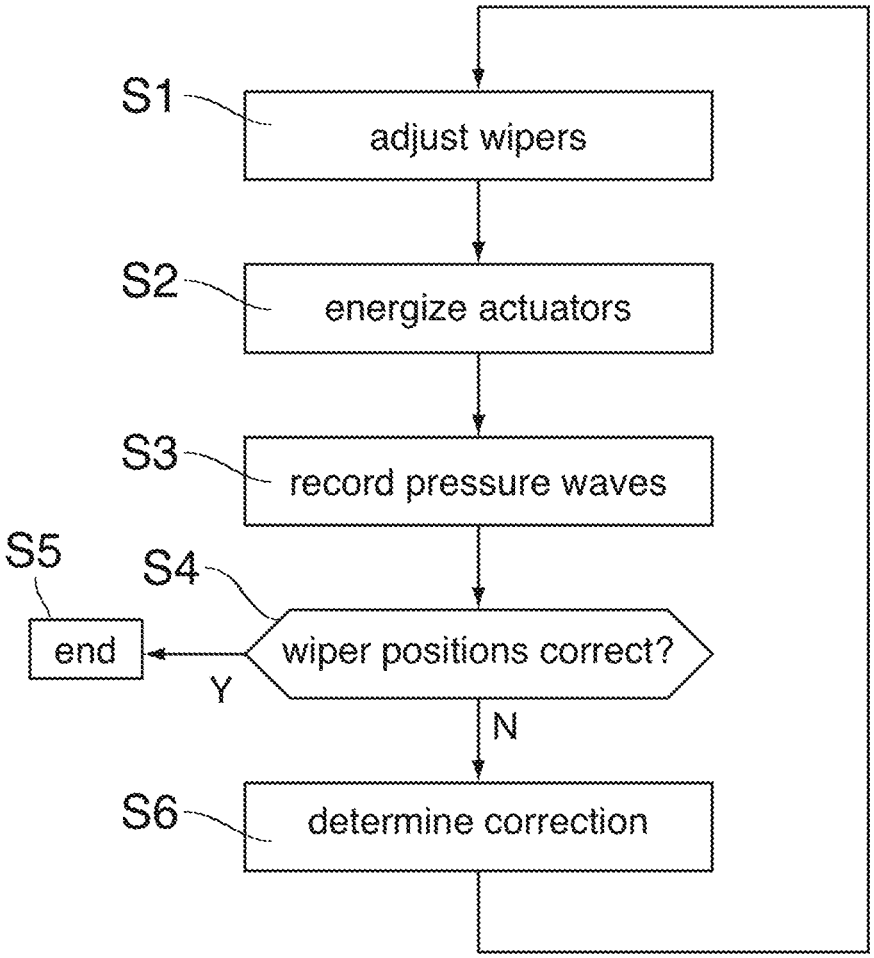
FIG. 7 is a flow diagram illustrating essential steps of the method according to the invention.

FIG. 7 is a flow diagram illustrating essential steps of a procedure for calibrating the position of the wipers 40 relative to the print heads 10. This method may be used for calibrating the positions in any of the degrees of freedom discussed above.

In a first step S1 the positions of the wipers relative to the print heads are adjusted, using the adjusting devices 52 or the adjusting devices of the wiper mounts 50, until it can be expected that the wipers will engage the nozzle plates of all print heads.

In step S2, the actuators 30 of some or all printing elements of some or all print heads are energized in order to cause pressure waves in the liquid (ink or cleaning liquid) contained in the pressure chambers 20. The intensity of the energizing pulses may be such that droplets are expelled from the nozzles 26. Optionally, the intensity may be reduced to a level where pressure waves are excited but no droplets are expelled.

In step S3, the detection systems 36 of the pertinent print elements are used for recording the pressure waves and the functions P(t) which will then be analyzed further in the processor 42.

Then, it is checked in step S4 whether the detected patterns of the pressure waves match with reference patterns that indicate a correct position of the wiper, at least for one printing element in each print head. If it is found that all wiper positions are correct (Y), the process ends with step S5. Otherwise (N) the detected pressure wave patterns may be used for determining a correction in step S6, either by try-and-error or by calculations based on the timings, the numbers of the nozzles or the print heads for which the presence of the wipers has been detected.

Optionally, the processor 42 may be connected to a display where a proposal for a correction is displayed, so that an operator may be perform the proposed adjustment operations manually. In another embodiment, the corrections may be output to electro-motoric drives for the adjusting devices 52 for the guide rail 46 and/or the wiper mounts 50, so that the adjustment operations are performed automatically.

When the corrections have been made, the process loops back to step S1 to test the corrected adjustment positions of the wipers.

The invention claimed is:

1. A method of calibrating a wiper position in an ink jet printer comprising a plurality of print heads, each of the plurality of print heads having a nozzle plate and a wiper mounted on a common base comprising a wiper carriage movable along a guide rail arranged to wipe the nozzle plate, the nozzle plate having a number of nozzles each of which is in fluid communication with a pressure chamber, each pressure chamber having an actuator for exciting a pressure wave in a liquid in the pressure chamber, and a detection system arranged to detect pressure fluctuations in the pressure chamber, said method comprising the steps of:

a) adjusting the wiper to a position in which it is set against the nozzle plate;

b) exciting a pressure wave in at least one of the pressure chambers;

c) recording the pressure fluctuations in said at least one pressure chamber;

d) deciding, on the basis of the detected pressure fluctuations, whether the wiper is set correctly against the nozzle that is in fluid communication with said at least one pressure chamber; and e) correcting the position of the wiper if necessary;

wherein the steps a) and e) comprise adjusting a position of the guide rail.

2. The method according to claim 1, wherein the plurality of print heads have nozzle plates arranged in a common plane, and wherein the steps (b) to (d) are performed for at least one of the pressure chambers of each of at least two of the print heads.

3. The method according to claim 1, wherein the steps b)-d) are repeated for different positions of the wiper carriage along the guide rail.

4. The method according to claim 1, wherein each of the wipers has a respective wiper mount, and wherein the steps a) and e) comprise adjusting the wiper mount of each wiper.

5. The method according to claim 1, wherein the step b) comprises exciting a pressure wave in a plurality of pressure chambers associated with adjacent nozzles, and the step d) comprises identifying the nozzles against which the wiper has been set.

6. An ink jet printer having a nozzle plate and a wiper arranged to wipe the nozzle plate, the nozzle plate having a number of nozzles each of which is in fluid communication with a pressure chamber, each pressure chamber having an actuator for exciting a pressure wave in a liquid in the pressure chamber, and a detection system arranged to detect pressure fluctuations in the pressure chamber, the printer further having a control circuit controlling the actuator, characterized by comprising a processor configured to control the control circuit and the detection system and to perform at least the steps b), c) and d) of the method according to claim 1.

7. A computer program product comprising program code on a machine-readable non-transitory medium, wherein the program code, when loaded into a processor controls a control circuit and a detection system of a printer turns the printer into a printer according to claim 6.

* * * * *